US006920747B2

(12) United States Patent
Burchert

(10) Patent No.: US 6,920,747 B2
(45) Date of Patent: Jul. 26, 2005

(54) COMBING RING FOR AN OPENING ROLLER OF AN OPEN-END SPINNING ARRANGEMENT AND METHOD OF MAKING SAME

(75) Inventor: Mathias Burchert, Ostfildern (DE)

(73) Assignee: Maschinenfabrik Rieter AG, Wintherthur (CH)

( * ) Notice: Subject to any disclaimer, the term of this patent is extended or adjusted under 35 U.S.C. 154(b) by 0 days.

(21) Appl. No.: 10/689,597

(22) Filed: Oct. 22, 2003

(65) Prior Publication Data

US 2004/0079069 A1 Apr. 29, 2004

(30) Foreign Application Priority Data

Oct. 22, 2002 (DE) ..... 102 49 905

(51) Int. Cl.[7] ..... D01H 4/32
(52) U.S. Cl. ..... 57/408; 57/112
(58) Field of Search ..... 57/408, 112

(56) References Cited

U.S. PATENT DOCUMENTS 5,164,236 A 11/1992 Schmid ..... 428/344
6,228,483 B1 * 5/2001 Sarin ..... 428/336

FOREIGN PATENT DOCUMENTS

| | | |
|---|---|---|
| DE | 40 08 637 | 9/1991 |
| DE | 41 01 680 | 7/1992 |

* cited by examiner

*Primary Examiner*—John J. Calvert
*Assistant Examiner*—Shaun R Hurley
(74) *Attorney, Agent, or Firm*—Crowell & Moring LLP

(57) ABSTRACT

A combing ring for an opening roller of an open-end spinning arrangement is provided with at least two surface coatings, one applied on top of the other. Of these two coatings, the bottom one is a wear-resistant, harder PVD coating, while the upper one is a less hard, but fiber-friendly coating having a maximum thickness of 5 $\mu$m, preferably a chemical nickel coating. The bottom PVD coating comprises in a known way so-called droplets, whereby the thickness of the top coating is at least equal to the height of the droplets.

6 Claims, 3 Drawing Sheets

COMBING RING FOR AN OPENING ROLLER OF AN OPEN-END SPINNING ARRANGEMENT AND METHOD OF MAKING SAME

BACKGROUND AND SUMMARY OF THE INVENTION

This application claims the priority of 102 49 905.5 filed in Germany on Oct. 22, 2002, the disclosure of which is expressly incorporated by reference herein.

The present invention relates to a combing ring for an opening roller of an open-end spinning arrangement, comprising at least two surface coatings, one applied on top of the other, of which the bottom one is a wear-resistant, harder coating, while the upper one is a less hard, but fiber-friendly coating having a maximum thickness of 5 μm.

Combing rings for opening rollers are exchangeable parts subject to high levels of wear which, up to the present, have always had to be replaced. Wear arises because the combing means or structure of the combing rings, usually needles or saw-teeth, engage with a fed sliver during the spinning process and thus release individual fibers from the sliver due to the high-speed rotation of the opening roller. The acceleration of the single fibers occurs hereby by means of the friction forces generated by the combing means, which in time results in wear of the combing means.

In order to keep the wear of the combing rings down to an acceptable level, modern combing rings, and in particular their combing structure, are usually provided with a wear-resistant nickel-diamond coating. The surface of the combing structure obtains a certain roughness, which has, however, proved itself in the processing of cotton fibers. For the processing of synthetic fibers, however, the nickel-diamond coating has proved to be too rough, causing damage to the fibers. Therefore, in processing synthetic fibers, the trend has been to apply either uncoated combing rings or combing rings having a chemical nickel coating. The life duration of such combing rings is, however, not sufficiently long.

In German published patent application DE 40 08 637 (corresponding U.S. Pat. No. 5,164,236) a combing ring of the above mentioned type is known, in which two different coatings are applied one after the other, which coatings have different functions. Firstly, a bottom coating, preferably a metal carbide coating, serves to prevent wear, while the subsequently applied coating, which is less resistant to wear, makes the surface of the combing ring smoother and protects the fiber material to be processed. In this case, a chemical, subsequent nickel-plating, having a coating thickness of between 3 and 5 μm, is involved.

In German published patent application DE 41 01 680 a non-generic combing ring is known, to which two coatings are applied, one after the other, which are both wear-resistant. The first coating consists preferably of tungsten carbide. The second coating consists preferably of chrome or titanium nitride, which is particularly applied in the PVD process and has a thickness of between 5 and 35 μm. PVD is the abbreviation for the commonly known expression Physical Vapour Deposition, a process which is, for example applied in the form of ion coating. The bottom coating is somewhat rougher, comprising microscopic valleys and peaks. The top coating is applied in such a way that it only thinly covers the peaks of the lower coating, while filling out the valleys to a great extent.

It is furthermore prior art to coat combing rings, which are intended for the processing of synthetic fibers, using only PVD coating technology. A coating of this type is very wear-resistant and permits significantly higher life durations in the case of processing synthetic material. These PVD coatings have the disadvantage, however, that the application of the coating does not occur evenly. Due to the nature of the process itself, defects occur in the coating, so-called droplets. These droplets form as bumps on the surface and result in a comparably rough surface, whereby the surface roughness is, however, less rough than that of the above mentioned nickel-diamond coating. The droplets are significantly softer than the usual surface layer generated by the PVD coating.

It is an object of the present invention to keep the known advantages of the PVD coating technology while creating an even more wear-resistant and fiber-friendly combing ring.

This object has been achieved in accordance with the present invention in that the bottom coating is applied as a PVD coating comprising the above mentioned droplets, while the thickness of the top coating corresponds at least to the height of the droplets. The top coating is preferably a chemically applied nickel coating.

According to the present invention, the initially applied PVD coating, unsatisfactory due to the presence of the droplets, is covered by a further coating, the thickness of which does not exceed 5 μm, but which measures at a minimum the same as the height of the droplets. When the combing ring is in operation, the top coating, preferably a chemical nickel coating, comes into effect first during the run-in phase. In this phase the wear rate is very high, as the level of hardness of the top coating is very low. At the same time, the relatively soft droplets are worn away. After a run-in phase, the bottom PVD-coating comes into action. This now has an even, fiber-friendly surface and due to the high degree of hardness, also a high wear resistance.

These and further objects, features and advantages of the present invention will become more readily apparent from the following detailed description thereof when taken in conjunction with the accompanying drawings wherein

DETAILED DESCRIPTION OF THE DRAWINGS

Figure 1:
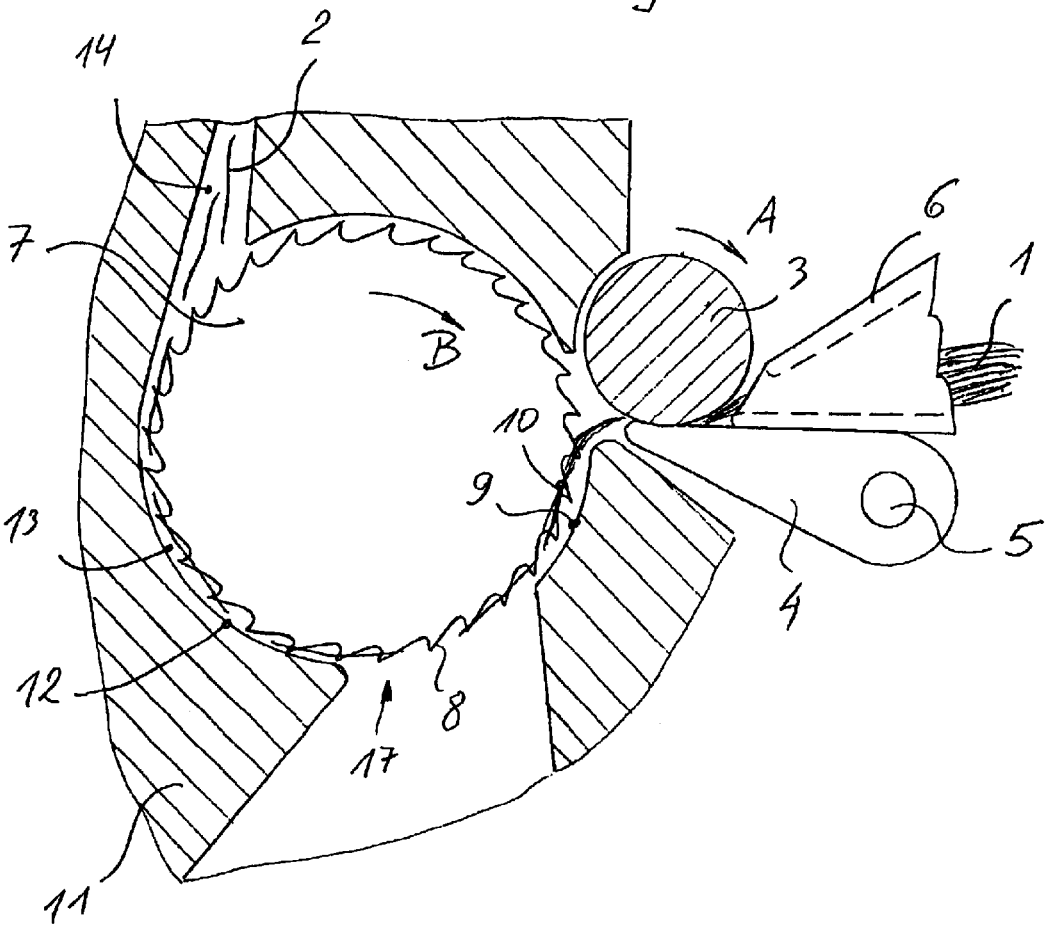
FIG. 1 is a partly sectional side view of an opening device of an open-end spinning arrangement comprising an opening roller, constructed according to a preferred embodiment of the present invention.

An opening device of an open-end spinning arrangement is only schematically shown in FIG. 1. The opening device serves to feed a sliver 1 and to open it to single fibers 2. Among other components provided is a feed roller 3 driven in rotational direction A, to which a feed table 4 is flexibly pressed. The feed table 4 can be swivelled around a swivel axle 5 and loaded against the feed roller 3 by means of a loading spring (not shown). A nipping line is hereby formed between the feed roller 3 and the feed table 4, against which nipping line the sliver 1 is nipped during its transport. An entry funnel 6 for the sliver 1 is provided upstream of the feed table 3.

The feed roller 3 feeds the sliver 1 to be opened to single fibers 2 to a significantly faster driven opening roller 7, which opening roller 7 is driven in the same rotational direction B as the feed table 3. The opening roller 7 is provided with a needle or saw-toothed combing structure 8, which opens the single fibers 2 from the sliver 1.

Between the feed table 4 and the opening roller 7 a stationary fiber beard support 9 is arranged, which presses the end of the sliver 1 to be opened, the so-called fiber beard 10, into the combing structure 8 of the opening roller 7 from behind.

The above mentioned components are arranged on an opening roller housing 11. This housing 11 comprises at least one circumferential surface 12, which surrounds the opening roller 7 over a part of its circumference to form an annular space 13. A fiber feed channel 14 begins in the opening roller housing 11, which channel 14 feeds the opened single fibers 2 from the combing structure 8 of the opening roller 7 to a spinning rotor (not shown). The spinning rotor and thus the annular space 13 are connected for this purpose to a vacuum source (not shown) which serves the transport of the single fibers 2.

Figure 2:
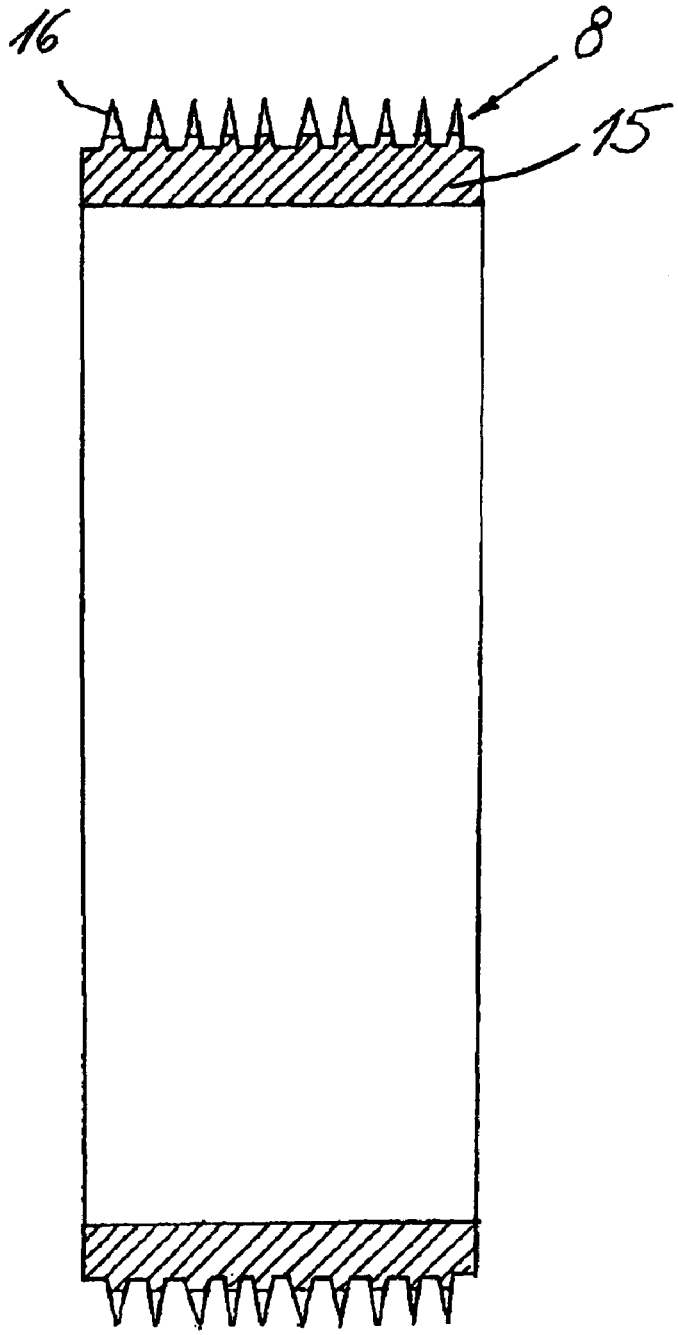
FIG. 2 is, in enlarged dimensions an axially intersected combing ring for an opening roller, constructed according to a preferred embodiment of the present invention.

The opening roller 7 comprises a combing ring 15 which is shown in FIG. 2 in axial intersection in larger than life dimensions, which combing ring 15 comprises the combing structure 8 and which is slid onto a base body (not shown) of the opening roller 7.

It is known from prior art that a combing structure in the form of a saw-toothed wire is wound in helical form around the circumference of the combing ring 15. It is also known that the combing structure 8 can be cut into the circumference of the combing ring 15, which gives rise to parallel, helix-shaped rows of teeth 16.

Opening rollers run at a speed of up to 8.000 rpm (revolutions per minute), whereby the teeth 16 run at a circumferential speed of up to 30 m (meters) per second. The teeth 16 of the combing structure 8 penetrate into the fiber beard 10 and comb it. Single fibers 2 are hereby drawn out of the fiber beard 10 as soon as the taking along forces of the opening roller 7 are stronger than the forces holding back the single fibers 2. The single fibers 2 are then accelerated along the remaining path around the circumference of the opening roller 7 and guided after approximately 180° via the fiber feed channel 14, tangentially annexing the opening roller 7, to the spinning rotor.

The acceleration of the single fibers 2 takes place by means of the frictional forces generated by the teeth 16 of the combing structure 8, which forces are supported by air streams which the opening roller 7 generates and which are reinforced by the low pressure exerted at the end (not shown) of the fiber feed channel 14. The air streams are sucked in via an air inlet 17.

Figure 3:
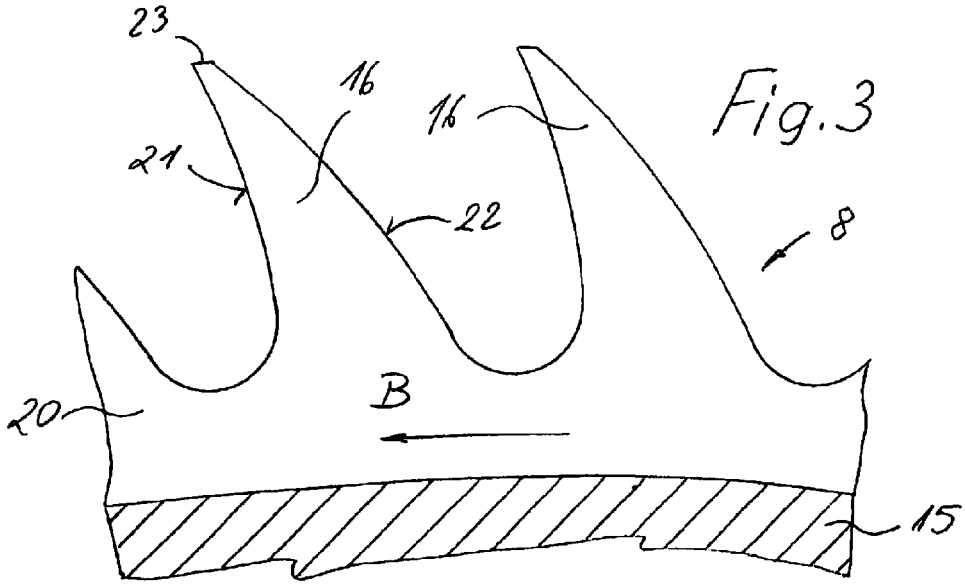
FIG. 3 is a side view of two teeth, twenty times larger than actual size, of a combing ring in a view taken in the same direction as FIG. 1.
Figure 4:
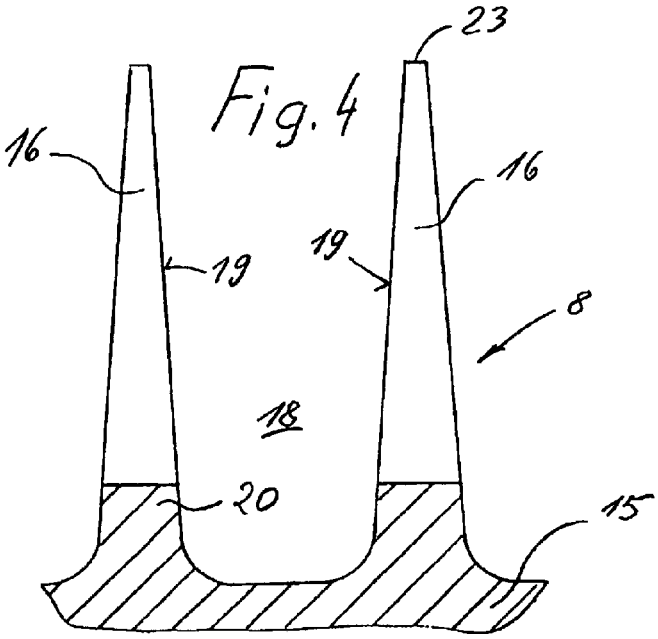
FIG. 4 is a side view of two teeth, also shown twenty times larger than actual size, of a combing ring taken in the same direction as in a view according to FIG. 2.

Several teeth 16 of the combing structure 8 are shown in FIGS. 3 and 4 at approximately 20 times their actual size. During transport around the circumference of the opening roller 7, the single fibers 2 are located in grooves 18 between the teeth 16, whereby, due to friction, the single fibers 2 are taken along and accelerated by the teeth flanks 19 of the teeth 16 in circumferential direction B.

The grooves 18 are bordered by continuous teeth bases 20, from which the actual teeth 16 rise up, each tooth comprising a tooth front 21, a tooth back 22, and two lateral tooth flanks 19 connected to respective tooth tips 23.

Figure 5:
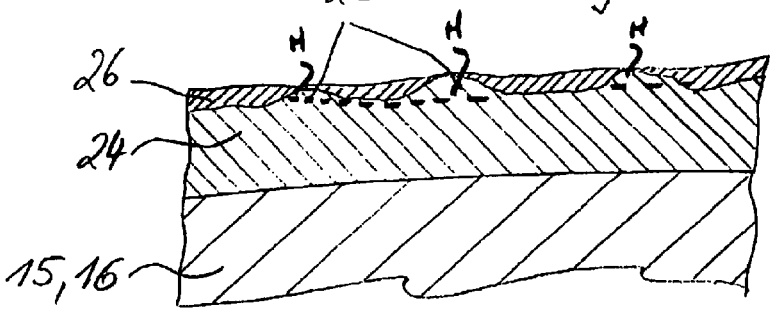
FIG. 5 is an axial sectional view in greatly enlarged dimensions of a part of a combing ring to illustrate the applied coatings.

Due to the way the combing structure 8 of the opening roller 7 works, the combing ring 15 is subject to severe wear. The surface of the combing structure 8 as well as preferably also the circumference of the combing ring 15 are therefore made more resistant in industry by means of a wear-resistant coating. This coating should be of such a kind, that sensitive fibers, in particular synthetic fibers, are not unnecessarily damaged by the roughness thereof. For this reason, a plurality of surface coatings are applied to the combing rings 15, one on top of the other, of which a bottom coating is a wear-resistant hard coating and a top coating is a less hard but more fiber-friendly coating. The bottom coating 24 is applied in FIG. 5 as a PVD coating, which comprises, in a disadvantageous way, so-called droplets 25, which are described above. The top coating 26 has a maximum thickness of 5 $\mu$m and corresponds in its thickness to at least the height H of the droplets 25. The top coating 26 is hereby in particular a chemically applied nickel coating.

When a new combing ring 15 is first put into operation, the top coating 26 comes into effect first, whereby in a run-in phase the rate of wear of this coating 26 is very high due its lesser degree of hardness. At the same time, however, the relatively soft droplets 25 are also worn down.

After a certain duration of the run-in phase, the bottom PVD coating 24 comes into effect, which now comprises a fiber-friendly surface and, due to its high level of hardness, is very wear-resistant.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Combing ring for an opening roller of an open-end spinning arrangement, comprising at least two surface coatings, one applied on top of the other, of which the bottom one is a wear-resistant, harder coating, while the upper one is a less hard, but fiber-friendly coating having a maximum thickness of 5 $\mu$m, wherein the bottom coating is applied as a PVD coating and droplets of bottom coating material formed at an outer surface of the bottom coating are less hard than the bottom coating material thereunder, and the thickness of the top coating measures at the least the same as the height of the droplets.

2. Combing ring according to claim 1, wherein the top coating is chemically applied nickel coating.

3. A method of making a combing ring for an opening roller of an open-end spinning arrangement, comprising:

forming a combing ring with combing structures thereon, applying a first wear-resistant hard coating to the coating ring as a PVD coating comprising droplets having a droplet thickness forming unevenness in the total thickness of the first layer, wherein the droplets formed at an outer surface of the bottom coating are less hard than the bottom coating material thereunder, and applying a second less hard fiber-friendly coating on top of said first coating, said second coating having a maximum thickness of 5 $\mu$m and a thickness at least as great as the droplet thickness.

4. A method of making a combing ring according to claim 3, wherein the second coating is a chemically applied nickel coating.

5. Combing ring for an opening roller of an open-end spinning arrangement, comprising a wear-resistant, hard bottom coating applied by a PVD-coating comprising droplets, the droplets being imbedded in a less hard and less wear-resistant top coating which, together with the droplets, will be worn off during a run-in phase leaving a smooth surface of the wear-resistant and harder PVD-coating.

6. Combing ring according to claim 5, wherein the top coating is a chemically applied nickel coating.

* * * * *